United States Patent [19]

Sollberger

[11] Patent Number: 5,033,515

[45] Date of Patent: Jul. 23, 1991

[54] LENGTHWISE PARTITIONED GRIPPER PROJECTILE FOR WEAVING MACHINES

[76] Inventor: Werner Sollberger, Kürzemattstrasse 21, CH-4566 Kriegstetten, Switzerland

[21] Appl. No.: 451,808

[22] Filed: Dec. 15, 1989

[30] Foreign Application Priority Data

Dec. 16, 1988 [CH] Switzerland ..... 4647/88

[51] Int. Cl.[5] ..... D03J 5/06

[52] U.S. Cl. ..... 139/438

[58] Field of Search ..... 139/438, 439, 437, 448

[56] References Cited

U.S. PATENT DOCUMENTS

| | | | |
|---|---|---|---|
| 3,163,184 | 12/1964 | Cherpin | 139/438 |
| 4,079,758 | 3/1978 | Conte | 139/438 |

FOREIGN PATENT DOCUMENTS

| | | | |
|---|---|---|---|
| 0091505 | 10/1983 | European Pat. Off. | 139/439 |
| 2356457 | 4/1975 | Fed. Rep. of Germany . | |
| 2641248 | 3/1978 | Fed. Rep. of Germany . | |
| 3234765 | 4/1984 | Fed. Rep. of Germany | 139/438 |
| 472524 | 6/1969 | Switzerland . | |
| 552092 | 7/1974 | Switzerland . | |

*Primary Examiner*—Andrew M. Falik

[57] ABSTRACT

A gripper projectile for weaving machines is partitioned in lengthwise direction according to a stepped partition line having at least one, but preferably several steps. A gripper spring device is inserted into the projectile and comprises two individual, mirror-image shaped, facing gripper springs secured by blocks in the projectile which penetrate into recesses of the springs. The projectile is assembled by laser or electron beam welding, or by cementing.

10 Claims, 3 Drawing Sheets

34
12
34A 12
14

14
12

12
17A
17
16
13
34
15
18
15
34

36
37
37
39
38
40
42

20
22
14
44
16
42
40

LENGTHWISE PARTITIONED GRIPPER PROJECTILE FOR WEAVING MACHINES

This invention belongs to the technical field of weaving. More particularly, it is related to a new and useful gripper projectile shuttle for weaving machines.

Gripper projectile shuttles are used to introduce the weft into the shed during weaving. The weft yarn spool is positioned outside the weaving shed. The projectile is a hollow body which contains a gripper spring in its interior. When the weft is to be introduced into the shed, the gripper spring of the projectile is opened from the outside, the weft yarn is carried between the clamping surfaces of the gripper, the gripper is closed, and the shuttle is shot through the shed by a shooting device. On the opposite side of the fabric under weaving, the shuttle is opened and transported back to the original position of weft gripping and shooting.

All these operations are well known. Where shuttles are shot through the shed and are gathered on the other side of the fabric by a catcher device, the shuttles are shaped as an oblong projectile and also called projectile shuttles.

Common projectile shuttles are composed of only two main parts, namely (A) the hollow shuttle body of generally octagonal section, having a conical head, a flat end to be contacted by the shooting device, a through eye for the introduction of a tapered pin in order to open the gripper, and a recessed end portion leaving the clamping surfaces of the gripper spring accessible, and (B) the gripper spring. The spring has the general shape of a long U and is inserted from behind into the hollow body.

These known projectiles suffer from the disadvantage that they are very costly to be manufactured. The production of a hollow body whose inner walls must be machined to receive the gripper spring is difficult and expensive. Futhermore, since the projectile is shot with accelerations of about 1,000 g, the gripper spring is very difficult to be resiliently but rigidly secured in the hollow body.

German published patent application no. DE-Al-3234765 discloses a projectile whose hollow body is partitioned in the plane of the gripper spring. Thus, a bottom part and a cover part are formed which can be manufactured in a less complicated manner, e.g. by casting. The gripper spring can be inserted more easily and fixed in the lower part of the projectile. The upper part is then laid on the lower part, and the two parts are united by two rivets.

However, this shuttle suffers from the deficiency that it is easily deformed by the very high forces of the shooting. In the publication itself, it is said that the shear load on shooting and braking is very high, and that the rivets alone would not withstand these loads. The patent application suggests to relieve the rivets by steel rings. This solution is however expensive and not fully reliable. Furthermore, even with this partitioned execution of the projectile body where the insertion of the gripper spring is easier than before, the latter is still rather expensive to manufacture. The yoke between the two U arms must be of relatively soft steel since it must comprise a boring for one of the said rivets, and at least the U arms must be hardened.

It is a first and major object of this invention to eliminate the drawbacks and deficiencies of known gripper projectiles while keeping their advantages. Another object is to provide a new and useful gripper projectile which can be manufactured still less expensively and whose assembly can be effected more rapidly.

Still another object of this invention is to provide a gripper projectile wherein the gripper spring is much less complicated to manufacture and to insert and where the inserted spring is better fixed and more reliable in operation.

These objects and still others are met by the present invention. An important feature is the fact that the partition line between the upper and the lower parts of the projectile is not flat but stepped, whereby the steps may be either unidirectional, i.e. always downwards from one end to the other, or alternating, i.e. first up, then down etc., or according to a combination thereof. At least one step is necessary; preferred are more than one step, e.g. two, three or four. A second important feature is the fact that the gripper spring is composed of two mirror-inverted shaped partial spring elements as it will be shown later in detail.

Third, another feature of the invention is the welding together of the two halves of the projectile which eliminates the need for rivets with their inherent risks.

BRIEF DESCRIPTION OF THE DRAWINGS

The invention will now be described more in detail by means of an embodiment thereof, represented in the drawing and given by way of example only and not being construed to limit the invention thereto.

In the drawings.

DETAILED DESCRIPTION OF THE PREFERRED EMBODIMENTS

The projectile shown in the Figures is foreseen for the use in weaving machines, for the introduction of the weft into the shed, said weft being withdrawn from weft yarn spools positioned outside the weaving site, thus not contained in the shuttle.

Figure 1:
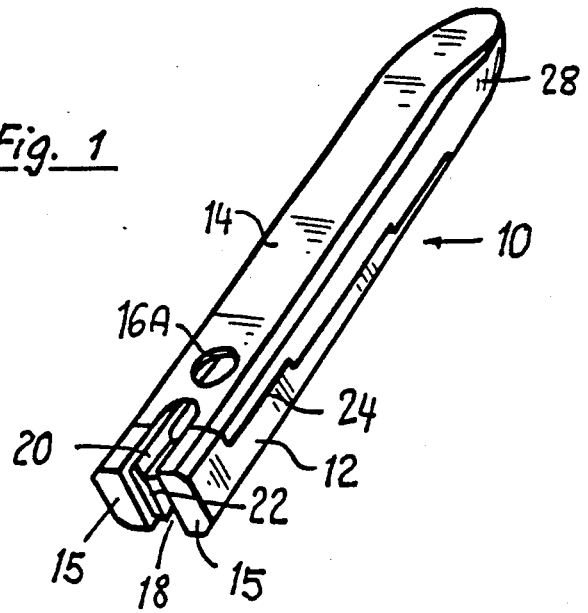
FIG. 1 is a perspective view of the projectile of the invention.

In FIG. 1, the shuttle is generally referred to as 10. It can be seen already from this Figure that the shuttle is partitioned into a lower part (or bottom part) 12 and an upper part (or cover part) 14, and that the partition line 24 is not a straight line but a stepped one. The two parts 12 and 14 are secured together not by riveting but by welding; the welding by laser or by an electron beam is preferred since conventional welding sometimes leads to hardening losses of the projectile itself which may be detrimental due to the extremely high forces applied on picking. If plastics materials are used for the shuttle, the two parts will be cemented together.

Figure 2:
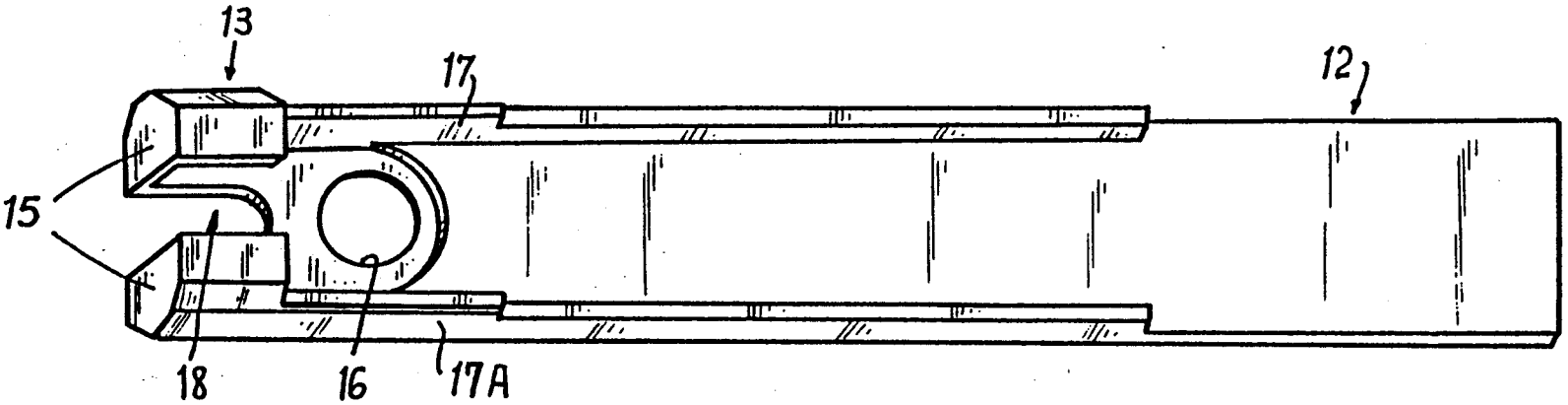
FIG. 2 is a perspective top view of the lower part of the partitioned projectile.
Figure 3:
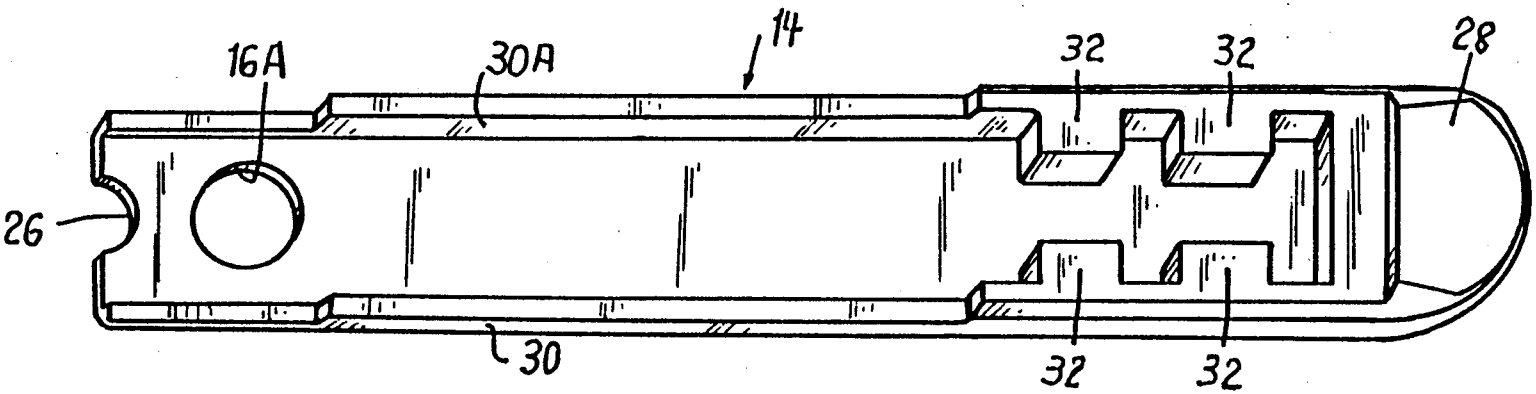
FIG. 3 is a perspective top view of the upper part of the partitioned projectile, said upper part being inverted by 180° about its lengthwise main axis.

From FIGS. 1, 2, and 3, it can be seen that the lower part 12 is a generally flat member comprising the whole rear portion 13 of the projectile having the impact surfaces 15, a recess 18 allowing the entry of the weft feeder device, and an opening eye 16. Furthermore, it can be seen that there are two stepped side walls 17,17A whose upper surfaces form the partition line 24 (FIG. 1). The upper part 14 is also a generally flat member, shown from below in FIG. 3, which comprises an opening eye 16A aligned with the eye 16 of the lower part 12, a slightly recessed rear portion 26 which is aligned with the rounded end of the recess 18 of the lower part 12, the whole rounded front portion 28 of the projectile, side walls 30,30A being stepped and fitting to the corresponding side walls 17,17A of the lower part 12, and rectangular gripper spring fixing blocks 32 extending from the walls 30,30A to the interior of the upper part 14.

Figures 4A, 4B, 5, 6A, 6B, 7:
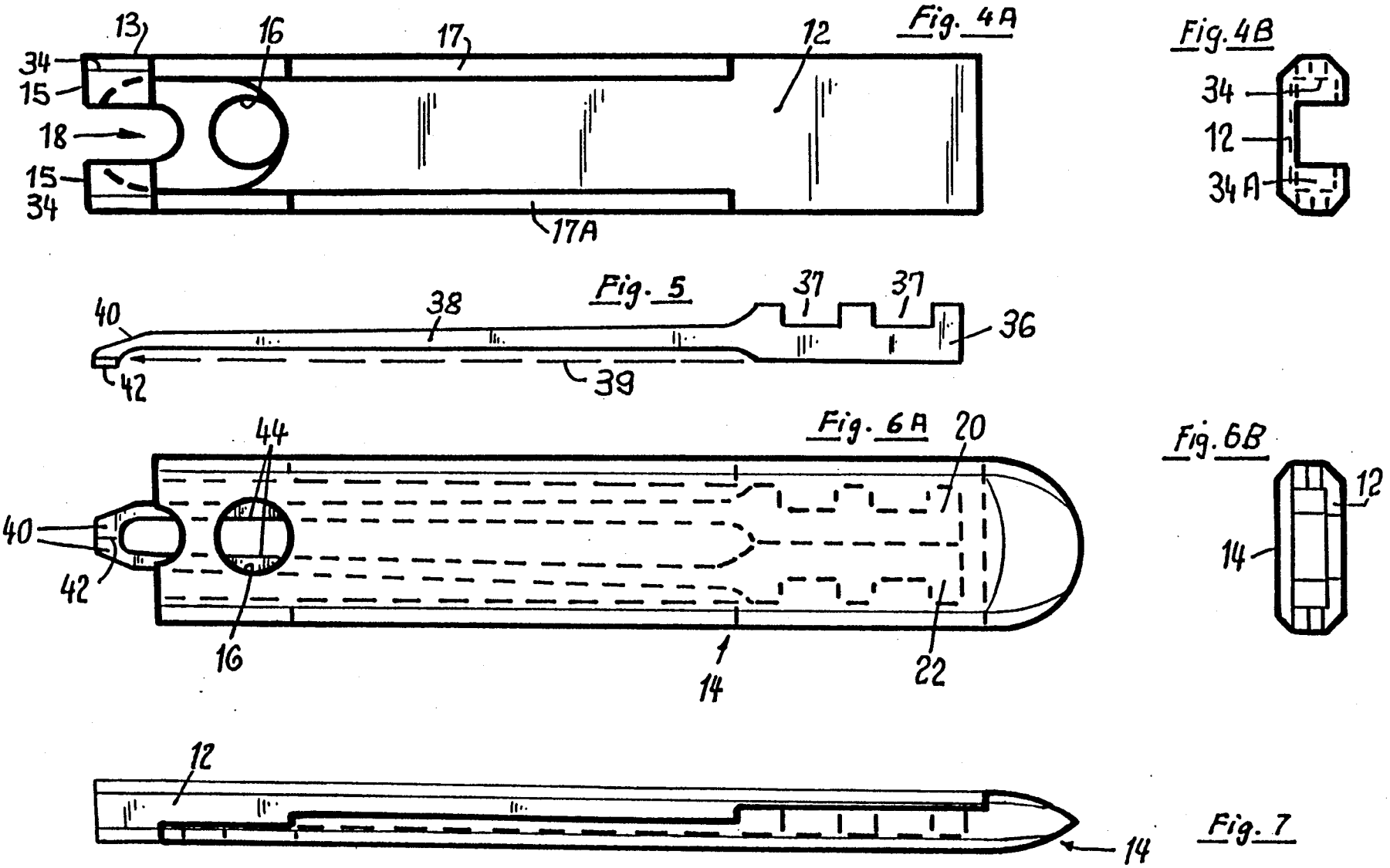
FIG. 4A is a top plan view of the lower part shown in FIG. 2.
FIG. 4B is a rear view of the part of FIG. 2.
FIG. 5 is a top plan view of one of the two gripper springs.
FIG. 6A is a top plan view of the upper part shown in FIG. 3.
FIG. 6B is a rear view of the part of FIG. 6A without showing the gripper springs.
FIG. 7 is a side view of the upper part shown in FIG. 6A.

FIGS. 4A and 4B show, respectively, a top view and a rear view of the lower part 12. The references correspond to those used in FIGS. 1,2, and 3. From FIGS. 4A and 4B, it can be seen that the impact blocks 13 are hollow and laterally recessed up to the surfaces 34, 34A, which allows to enlarge the gripping surfaces of the gripper springs 20 to be described below.

Figure 8:
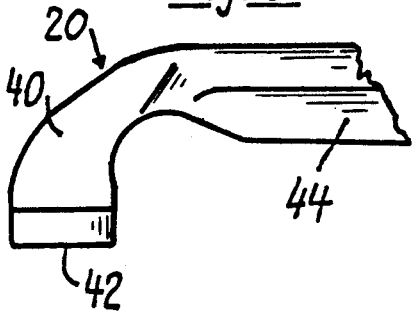
FIG. 8 is a view of the rear end portion of one gripper spring shown in FIG. 5.

One gripper spring 20 is shown in FIG. 5. It comprises a head portion 36 shaped as a flat block having rectangular recesses 37; the block 36 with its recesses 37 fits in with the corresponding parts 32 (FIG. 3) of the upper part 14 as it is shown in FIG. 6A. The spring 20 further comprises an elongated flat or circular rod portion 38 and a rear, gripping portion 40 (see also FIG. 8). This rear portion 40 ends in gripping surfaces 42 which may be flat or indented.

This gripper spring 20 coacts with a second gripper spring 22 which is not separately represented but which is the exact mirror image of the spring 20. In FIG. 6A, it can be seen how the two springs 20, 22 are inserted into the upper part 14 to be firmly held by the blocks 32 coacting with the recesses 37, the gripping surfaces 42 facing one another and being in firm but resilient contact due to the fact that the prolongation of the head portion 36 of the springs is a line 39 which ends not in the surfaces 42, but somewhat behind them, i.e. it intersects the head portion of the spring, see FIG. 5. The springs 20,. 22 are fixed within the upper part 14 by upsetting, cementing or spot welding.

Figure 9:
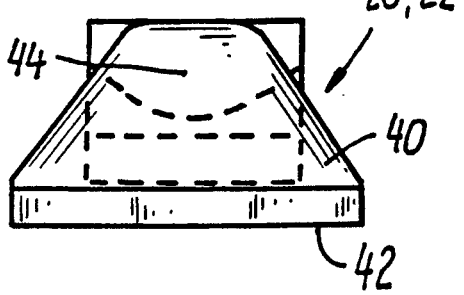
FIG. 9 is a rear view of the end portion of the gripper spring shown in FIG. 8.

The gripper springs 20, 22 comprise a specially shaped portion 44 in the region under the opening eye 16. This portion is specially hardening-treated, e.g. diamondized, and rounded (see FIG. 9) in order to withstand without substantial wear the repeated action of the opening pin.

The lower and the upper parts of the projectile can be manufactured by casting, stamping, cold extrusion or by machining from an appropriate steel or plastics material. The gripper springs are forged from steel and then machined and hardened. The assembled projectile is closed on the impact side, the recess for the weft feeder excepted, in order to distribute the impact energy on an extended surface. The friction coefficient is improved by an appropriate thermal finish of critical projectile surfaces together with a coating of a mechanically resistant material. Hardening of stressed parts and surfaces is preferably operated until a Vickers hardness up to about 5,000. The wear of the projectile can thus be kept to a minimum.

By the straight shape and arrangement of the gripper springs, to the contrary of curved and yoked springs of the prior art, acceleration energy is neutralized without creating oscillations of the spring. Thus, the occurence of so-called "losers" which means projectiles losing the clamped weft during introduction into the shed, is minimized.

The gripping surfaces (42) may have a length, measured in transverse direction to the longitudinal axis of the gripper spring, of up to about 5 mm but are generally provided with a normal length of about 3 to 4 mm. The recesses (34) in the impact block (13) permit a better clamping of the springs during weft feeding.

The absence of additional parts such as rivets, bolts, screws etc. and the perfect inertial symmetry of the projectile contribute to a more quiet trajectory motion and a better stability of the projectile.

Although the invention has been described in connection with a preferred embodiment thereof, it will be appreciated by those skilled in the art that modifications, additions, substitutions, and deletions may be made without departing from the spirit and scope of the invention as defined in the appended claims.

What is claimed is:

1. A gripper projectile shuttle for weft yarn in a weaving machine, the shuttle having a hollow body with a front having a rounded head portion and a rear having a rear impact block, a gripper spring contained in the body; the body being partitioned in the lengthwise direction into a lower part and an upper part, both of the body parts having an opening eye therethrough for an external opening device and also having a rearward opening recess for allowing the entry of a weft yarn feeding device, the lengthwise partition of the body into the lower and upper parts is along respective engaging partitioning surfaces of the lower and upper parts, and at least one cooperating complementary step being defined in both of the partitioning surfaces, wherein the complementary steps engage each other to prevent relative shifting of the parts in the frontward and rearward directions of the shuttle, the gripper spring comprises two mutually mirror-image shaped individual co-acting gripper springs, and the lower and upper parts being assembled together and being free from mechanical assembling parts.

2. The gripper projectile of claim 1, wherein said partition surface of said upper part comprises three downwardly directed steps.

3. The gripper projectile of claim 1, wherein said lower part includes the whole said rear impact block, whereas the upper part includes the whole said rounded head portion.

4. The gripper projectile of claim 1, further comprising rectangular internal fixing blocks located in said upper part for holding said individual gripper springs, said fixing blocks facing each other symmetrically, and said gripper springs each comprising a spring head portion having rectangular recesses shaped for fitting in with said fixing blocks, and means securing said springs to said fixing blocks.

5. The gripper projectile of claim 4, wherein said gripper springs each comprise a gripping end opposite said spring head portion thereof for gripping said weft yarn; said springs being shaped such that a line extended from the rear side of said spring head portion intersects the gripping end of said spring.

6. The gripper projectile of claim 1, wherein both individual said gripper springs include a respective portion which extends through the region of said body parts having said opening eye, and said spring portions are rounded and surface treated for permitting opening of said gripper spring device without wear at the moment of weft feeding.

7. The gripper projectile of claim 1, wherein said rear impact block has two separate side portions separated by said rearward recess, each said side portion including an inner side which faces said inner side of the other said side portion, and each said inner side is laterally recessed for allowing clamping of the weft yarn.

8. A gripper projectile shuttle for weft yarn in a weaving machine, the shuttle having a hollow body with a front having a rounded head portion and a rear having a rear impact block; a gripper spring contained in the body for gripping weft yarn; the body being partitioned in the lengthwise direction into a lower part and an upper part; both of the body parts having a rearward opening recess for allowing the entry of a weft yarn feeding device, the lengthwise partition of the body into the lower and upper parts is along respective engaging partitioning surfaces of the lower and upper parts, and at least one cooperating complementary step being defined in both of the partitioning surfaces, wherein the complementary steps engage each other to prevent relative shifting of the parts in the frontward and rearward directions of the shuttle, and the lower and upper parts being assembled together and being free from mechanical assembling parts.

9. The gripper projectile of claim 8, wherein said partition surfaces each include three steps directed downwardly in said upper part, seen in the frontward and rearward directions of the projectile.

10. The gripper projectile of claim 8, wherein said lower part includes the whole said rear impact block, whereas the upper part includes the whole said rounded head portion.

* * * * *